US010533329B2

(12) United States Patent
Hayman et al.

(10) Patent No.: US 10,533,329 B2
(45) Date of Patent: Jan. 14, 2020

(54) LOCKABLE SCAFFOLD TOEBOARD SYSTEM

(71) Applicant: Deltak Manufacturing, Inc., Walker, LA (US)

(72) Inventors: Yates Westley Hayman, Walker, LA (US); Johnny Curtis, Denham Springs, LA (US)

(73) Assignee: Deltak Manufacturing, Inc., Walker, LA (US)

( * ) Notice: Subject to any disclaimer, the term of this patent is extended or adjusted under 35 U.S.C. 154(b) by 13 days.

(21) Appl. No.: 15/790,705

(22) Filed: Oct. 23, 2017

(65) Prior Publication Data

US 2018/0044929 A1 Feb. 15, 2018

Related U.S. Application Data

(63) Continuation of application No. PCT/US2016/028892, filed on Apr. 22, 2016.
(Continued)

(51) Int. Cl.
*E04G 3/32* (2006.01)
*E04G 5/14* (2006.01)
(Continued)

(52) U.S. Cl.
CPC ..... *E04G 5/145* (2013.01); *E04G 1/152* (2013.01); *E04G 7/22* (2013.01); *E04G 7/307* (2013.01);
(Continued)

(58) Field of Classification Search
CPC ..... E04G 5/145; E04G 7/308; E04G 7/22; E04G 7/307; E04G 2007/285
(Continued)

(56) References Cited

U.S. PATENT DOCUMENTS 682,783 A * 9/1901 Brooks ..... E04G 1/30 182/113
1,270,906 A * 7/1918 Whitney ..... A63B 27/00 182/113
(Continued)

FOREIGN PATENT DOCUMENTS

CA 2983294 A1 * 10/2016 ..... E04G 1/152
CA 2988879 A1 * 1/2017 ..... E04G 3/20
(Continued)

OTHER PUBLICATIONS

European Patent Office—Search Report, Application 16783956.2 based on PCT/US1026/028892, dated Nov. 15, 2018, 7 pages.

*Primary Examiner* — Jerry E Redman
(74) *Attorney, Agent, or Firm* — Jones Walker LLP

(57) ABSTRACT

A scaffold toeboard system for locking a toeboard between two vertical scaffold members where each vertical scaffold member includes a tubular member having a diameter and an outer shape. The toeboard system includes a toeboard having an elongated member with a fixed terminating end and an adjustable terminating end. The toeboard further includes a front portion, a top portion, a bottom portion and a rear portion. The toeboard system further includes a locking mechanism slidably mounted to the adjustable terminating end, where the locking mechanism includes a lock member body with a front sidewall two fingers positioned on said locking mechanism and extending outwardly from the front sidewall of the locking member. The two fingers separated by a horizontal distance of about the diameter of a scaffold vertical member. The locking mechanism further includes a lock, where the lock is actuatable to fix the position of the lock member body with respect to the toeboard in a deployed position. The fixed terminating end is shaped to engage a scaffold vertical member.

12 Claims, 17 Drawing Sheets

NEXT GENERATION

Related U.S. Application Data

(60) Provisional application No. 62/152,490, filed on Apr. 24, 2015.

(51) Int. Cl.
*E04G 1/15* (2006.01)
*E04G 7/22* (2006.01)
*E04G 7/30* (2006.01)
*E04G 7/28* (2006.01)

(52) U.S. Cl.
CPC ..... *E04G 7/308* (2013.01); *E04G 2007/285* (2013.01)

(58) Field of Classification Search
USPC ..... 182/113
See application file for complete search history.

(56) References Cited

U.S. PATENT DOCUMENTS 1,471,304 A * 10/1923 Young ..... E04G 1/20 182/113
1,950,290 A * 3/1934 Benson ..... E04G 3/30 182/113
3,747,706 A * 7/1973 Paine ..... E04H 3/126 182/113
3,844,520 A * 10/1974 Werner ..... E04G 5/14 248/228.3
6,015,028 A * 1/2000 Smith ..... E04G 1/20 182/113
6,405,830 B1 * 6/2002 Hayman ..... E04G 5/14 182/113
7,971,686 B1 * 7/2011 Hayman ..... E04G 7/306 182/186.8
7,975,803 B2 * 7/2011 Schwoerer ..... E04G 1/15 182/178.1
8,206,052 B1 * 6/2012 Hayman ..... 182/186.8
8,905,292 B1 * 12/2014 Hayman ..... E04G 7/307 228/178
8,973,711 B2 * 3/2015 Hayman ..... E04G 7/304 182/186.8
9,015,950 B2 * 4/2015 Husebo ..... E04G 7/22 29/897.3
9,051,746 B2 * 6/2015 Rogers ..... E04G 5/08
2009/0052980 A1 * 2/2009 Williams ..... E04G 7/307 403/33
2010/0078264 A1 * 4/2010 Kreller ..... E04G 7/28 182/113
2010/0089697 A1 * 4/2010 Kreller ..... E04G 1/14 182/113
2013/0126270 A1 * 5/2013 Darby ..... E04G 5/14 182/113
2014/0299413 A1 * 10/2014 Hayman ..... E04G 7/32 182/186.8
2014/0318891 A1 * 10/2014 Crothers ..... E04G 5/14 182/113
2018/0274249 A1 * 9/2018 Hayman ..... E04G 7/308

FOREIGN PATENT DOCUMENTS

GB 2097055 A * 10/1982 ..... E04G 7/26
GB 2127887 A * 4/1984 ..... E04G 5/14
JP 05311864 A * 11/1993
JP H08326296 A 12/1996
JP H09151599 A 6/1997
JP 2005188023 A 7/2005
JP 2005207061 A 8/2005
WO WO-0222989 A1 * 3/2002 ..... E04G 7/307

* cited by examiner

TOP VIEW

FRONT VIEW
CUTBACK
CUTBACK
1
1
5
5
30
30
31
40
40
91
91
100
20
20
36
37
37
38
38
38
7A
7A
7B
300
360
366
366
366
377

TOE BOARD BODY DETAILS

TOE BOARD

FRONT VIEW INSTALLED

TOE BOARD
SIDE VIEW INSTALLED

TOE BOARD LOCK DETAILS

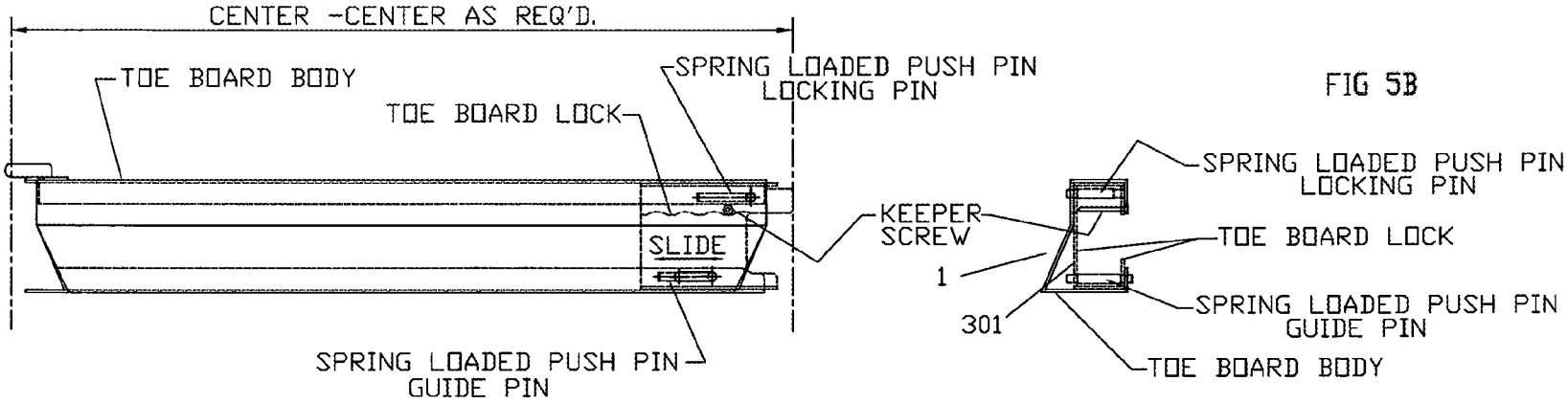
TOE BOARD ASSEMBLY DETAILS

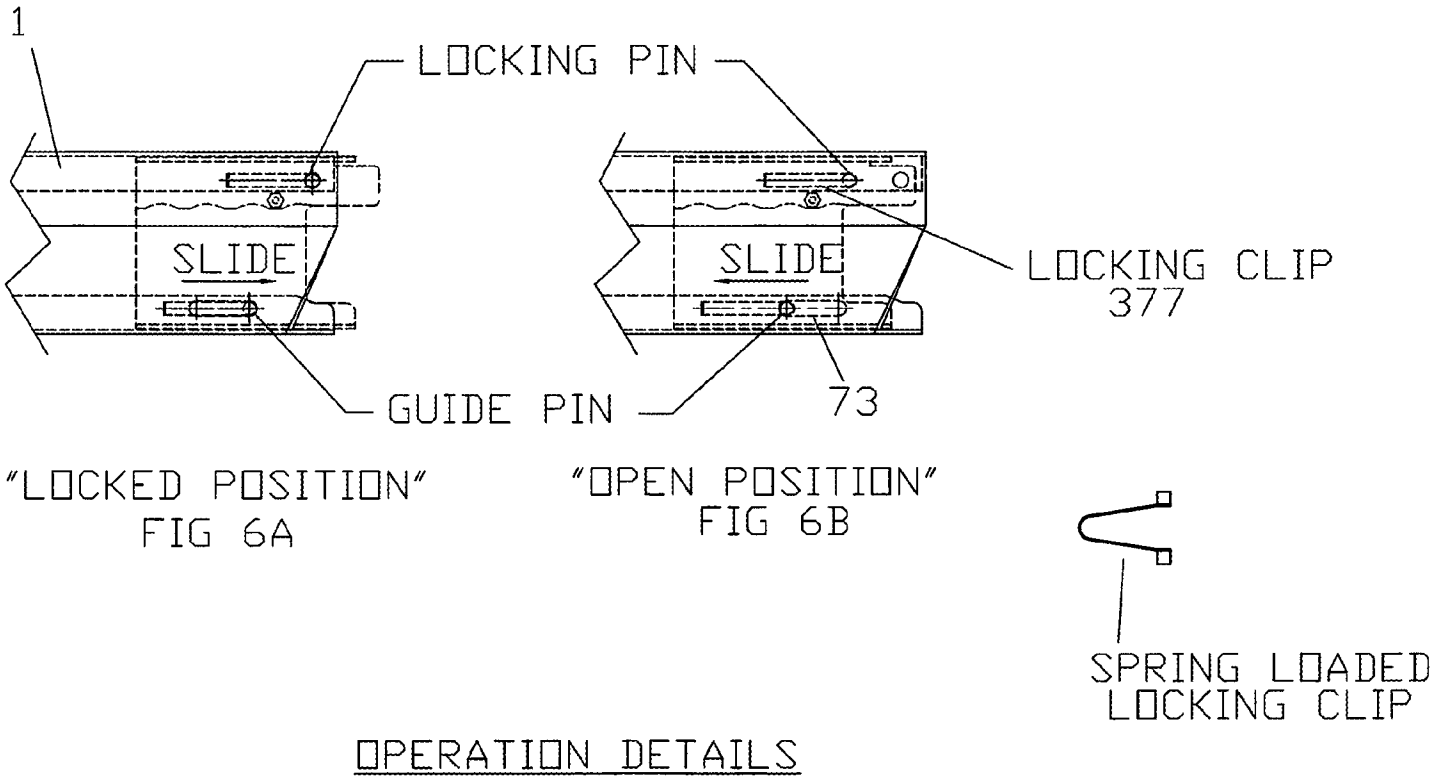
OPERATION DETAILS

PLAN VIEW

ELEVATION VIEW

SECTION "A"-"A"

SECTION "B"-"B"

SECTION "C"-"C"

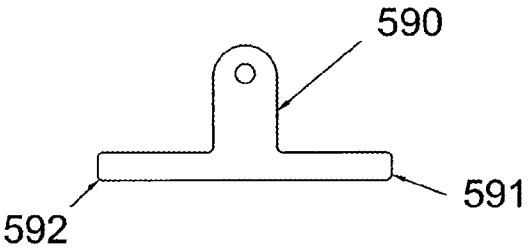
BAY ON BAY HOLD DOWN FLAT LAYOUT
FIG 9A
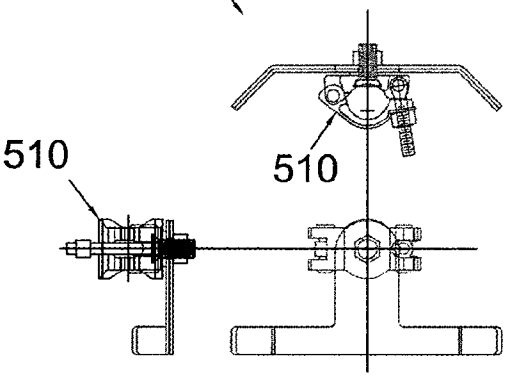
FIG 9C
FIG 9B
FIG 9D
BAY ON BAY HOLD DOWN ASSEMBLY
(HALF CLAMP)

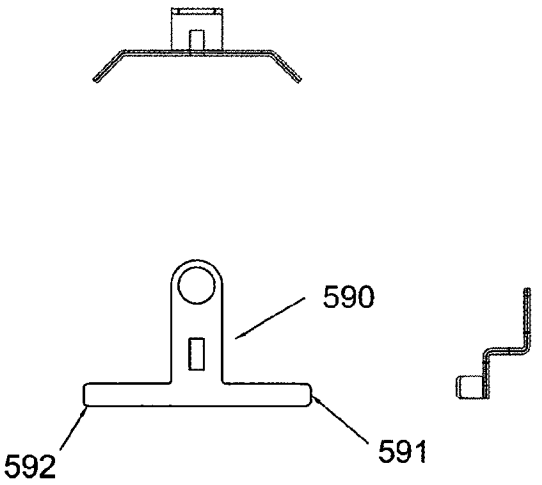
BAY ON BAY HOLD DOWN FLAT LAYOUT
FIG 10A
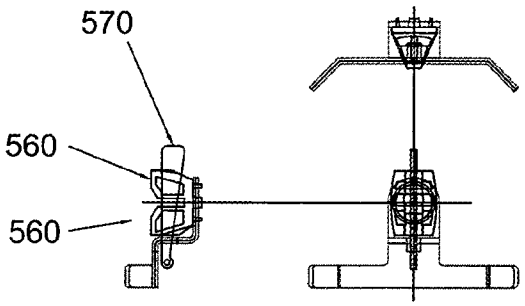
FIG 10C
FIG 10B
FIG 10D
BAY ON BAY HOLD DOWN ASSEMBLY (WEDGE LOCK)

600
DETAIL LEFT HAND TOE BOARD
HOLD DOWN PLATE
DETAIL PINLOCK CONNECTION
ADAPTER
1 REQ'D PER ASSEMBLY
LEFT HAND TOE BOARD HOLD
DOWN ASSEMBLY

SEE DETAIL LEFT
HAND TOE
BOARD HOLD DOWN
PLATE
600

SECTION "A"-"A"

SAFE WAY

SECTION "A"-"A"

NEXT GENERATION

SECTION "A"-"A"

WEDGE LOCK

700
SEE DETAIL TUBING GUSSET
USE DOMED BLIND SEALING RIVETS FOR 3/8" THK. MATERIAL
710
702
SECTION "B"-"B"

700
SEE DETAIL END CONNECTOR GUSSET
USE DOMED BLIND SEALING RIVETS FOR 3/8" THK. MATERIAL
710
703
SECTION "A"-"A"

703
701
710
700
702
SEE DETAIL RIVETED FILLER PLATE TOP
700
SIDE VIEW
SEE DETAIL FORMED STIFFENER CHANNEL
710
702
"B"
"B"
702
"A"
"A"
703
END VIEW
TOP VIEW

LOCKABLE SCAFFOLD TOEBOARD SYSTEM

CROSS REFERENCE TO RELATED APPLICATIONS

This application is a continuation of Application Number PCT/US16/28892, filed on Apr. 22, 2016, which claims priority to U.S. Provisional Application No. 62/152,490, filed on Apr. 24, 2015, and the contents of those applications are hereby incorporated by reference.

TECHNICAL FIELD

This invention relates to scaffolding, and in particular, to scaffold toeboard systems.

BACKGROUND ART

Scaffold structures generally have a framework of horizontal scaffold members (horizontal members or horizontals) and vertical scaffold members (vertical members or verticals) which create a structure for supporting an elevated platform work area. The platform decking generally consists of scaffold boards, constructed of either metal or wood. OSHA requires all scaffold decks to include "toeboards." Toeboards are boards that attach to the scaffold structure near the outer perimeter or edges of the work platform and function to keep materials from falling or rolling off the work platform. Toeboards can also be used to secure the platform deck to the scaffold frame.

The general practice is to use 2×4 or 2×6 lumber as toeboards. These wooden toeboards may be nailed to the platform or wired to the platform with tiewraps or bailing wire. As the work platform can vary in size, each platform requires toeboards to be cut to size on the job site, or that various standard sizes are kept in stock. Much scaffolding is exposed to weather. Due to weathering, wooden toeboards may be used several times, and then have to be discarded. Metal toeboards are available, such as metal boards that couple to a stub member or sleeve that attaches to a vertical scaffold member, such as described in U.S. Pat. No. 6,405,830, hereby incorporated by reference.

Modular system scaffold systems (system scaffolds) are scaffold horizontal and vertical members that use interlocking or latching horizontal scaffold members and vertical scaffold members. Generally, the vertical scaffold members have a series of vertically spaced apart outwardly extending annular members, such as upstanding cups or rosettes, onto which a connector, located on the end of a horizontal scaffold member, will latch or lock onto. System scaffolds are designed for ease of assembly and disassembly. Various system scaffolds are available with different latching systems, such as pivoting latched end connectors (Excel Modular Scaffold (see U.S. Pat. No. 5,028,164), or Next Generation Scaffold Systems or Next Gen, U.S. patent publication 2014/0299413), wedging latch members (Safeway Scaffold Systems) (horizontal wedge, see U.S. Pat. No. 4,445,307) or pin lock or wedge lock systems (vertical wedge, see U.S. Pat. Nos. 4,273,463 and 5,961,240), intermitting twisting cups (Cuploc Systems, see U.S. Pat. No. 3,992,118), and others. The vertical members in system scaffolds are generally tubular shaped (for instance, round or square in cross section) and will have a series of spaced apart annular members fixed on and extending outwardly from the tubular member. Each tubular member will have a diameter (for a cylinder, the diameter is the diameter of the cylinder; for a square cross-sectional tubular member, the diameter would be the width of the cross-section). The annular members, such as rosettes with openings therethrough, or upstanding cups, are spaced apart on the vertical tubular member to allow flexibility in the height of attachment of the horizontal members (which attach or rest on the annular members). The vertical spacing varies from manufacturer to manufacturer and system to system. Consequently, a toeboard system that can be used on most system scaffolds is desired, as well as a toeboard system that could be used on tube and clamp scaffolds, where the horizontal scaffold members terminate in tube clamps at each end, and simply clamp onto a vertical scaffold member.

OBJECTS OF THE INVENTION

It is an object of the invention to provide a scaffold toeboard system which is easily mounted on a scaffold frame and locked in place.

It is an object of the invention to provide a scaffold toeboard system where the toeboard directly couples to scaffold vertical members.

SUMMARY OF THE INVENTION

One embodiment of the invention includes a scaffold toeboard system for locking between two vertical scaffold members where each vertical scaffold member comprises a tubular member having a diameter and an outer shape. The toeboard system comprises a toeboard comprising an elongated member having a fixed terminating end and an adjustable terminating end, the toeboard further comprising a front portion, a top portion, a bottom portion and a rear portion. The toeboard system further includes a locking mechanism slidably mounted to the adjustable terminating end, the locking mechanism comprising a lock member body having a top sidewall, a bottom sidewall and a front sidewall, and two fingers positioned on said locking mechanism and extending outwardly from said front sidewall of the locking member, the two fingers separated by a horizontal distance of about the diameter of a scaffold vertical member. The locking mechanism further comprising a lock, said lock being actuatable to fix the position of the lock member with respect to the toeboard in the deployed position. The fixed terminating end is shaped to engage a scaffold vertical member.

BRIEF DESCRIPTION OF THE DRAWINGS

FIG. 5A is a front ghosted view of one embodiment of the toeboard with the lock member body of FIG. 4A installed thereon.

FIG. 5B is a cross sectional view through the toeboard system of FIG. 5A.

FIG. 6A is a detailed view of the adjustable end of the toeboard system of FIG. 5A in the locked position.

FIG. 6B is a detailed view of the adjustable end of the toeboard system of FIG. 5A in the open or unlocked position.

FIG. 9A is a front view of one embodiment of a toeboard holddown body.

FIG. 9B is a front view of one embodiment of a toeboard holddown.

FIG. 9C is a top view of the embodiment of the toeboard holddown of FIG. 9B.

FIG. 9D is a side view of the embodiment of the toeboard holddown of FIG. 9B.

FIG. 10A is a front view of one embodiment of a toeboard holddown body.

FIG. 10B is a front view of another embodiment of a toeboard holddown.

FIG. 10C is a top view of the embodiment of the toeboard holddown of FIG. 10B.

FIG. 10D is a side view of the embodiment of the toeboard holddown of FIG. 10B.

DETAILED DESCRIPTION

Figures 1A, 1B:
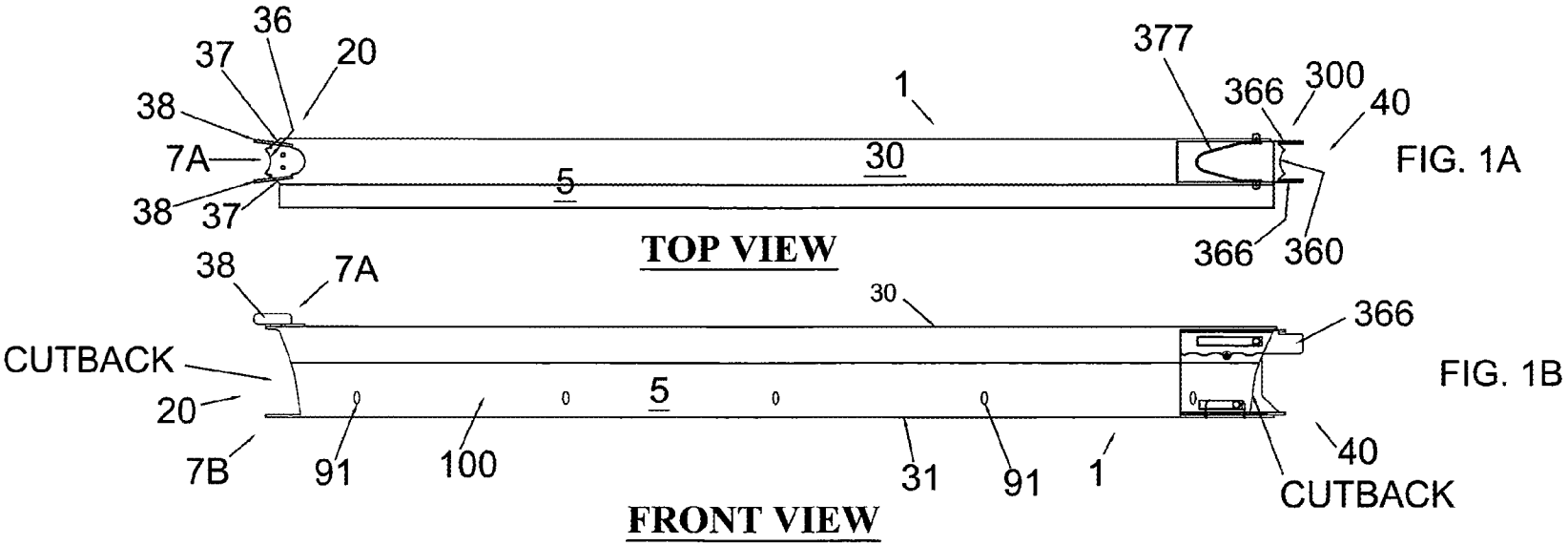
FIG. 1A is a top view of one embodiment of the scaffold toeboard system.
FIG. 1B is a front view of the toeboard system of FIG. 1A.
Figures 1C, 1D:
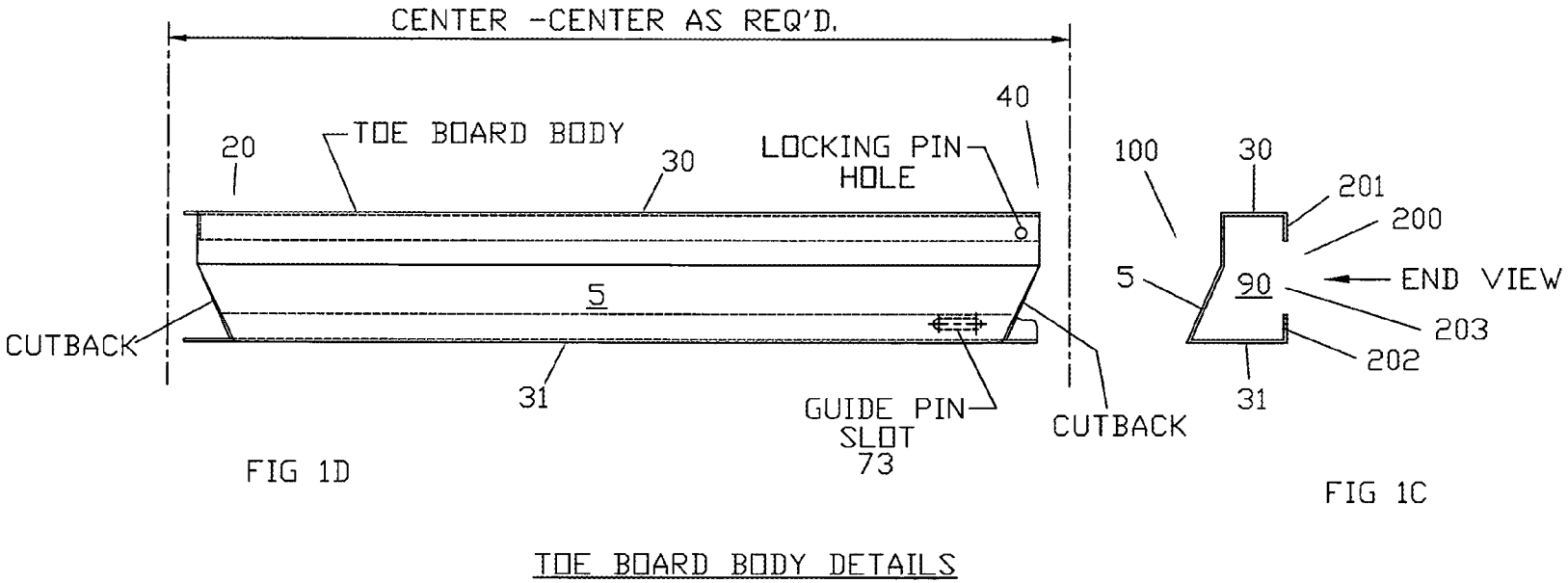
FIG. 1C is a cross section through one embodiment of a toeboard in the toeboard system.
FIG. 1D is a front view of one embodiment of a toeboard in the toeboard system.

Shown in FIGS. 1A, 1B, and 1C is one embodiment of a toeboard 1. The toeboard 1 is an elongated board like member. As shown in FIG. 1C, one embodiment is generally "U" shaped, preferably formed from lightweight metal pieces (such as aluminum, aluminum alloy or 18 gauge steel). As shown in the cross section of FIG. 1C, the toeboard 1 has a generally closed front side 100 that may include an outwardly extending sloped section 5. As shown, the section slopes so that the bottom portion 31 is wider (as measured on a line 90 degrees to the axis of the toeboard) than the top portion 30. The back side 200 of the toeboard has two opposed lip sections, 201 and 202, with on opening 203 between the lip sections, forming a split sidewall. The toeboard 1 could be closed on the rear side, but this is not preferred as this adds weight to the toeboard. The toeboard 1 has a top portion 30 and a bottom portion 31. The interior of the toeboard forms a channel 90. The toeboard front side 100, and top 30 and bottom portions 31, provide strength and rigidity to the toeboard 1.

Figure 2:
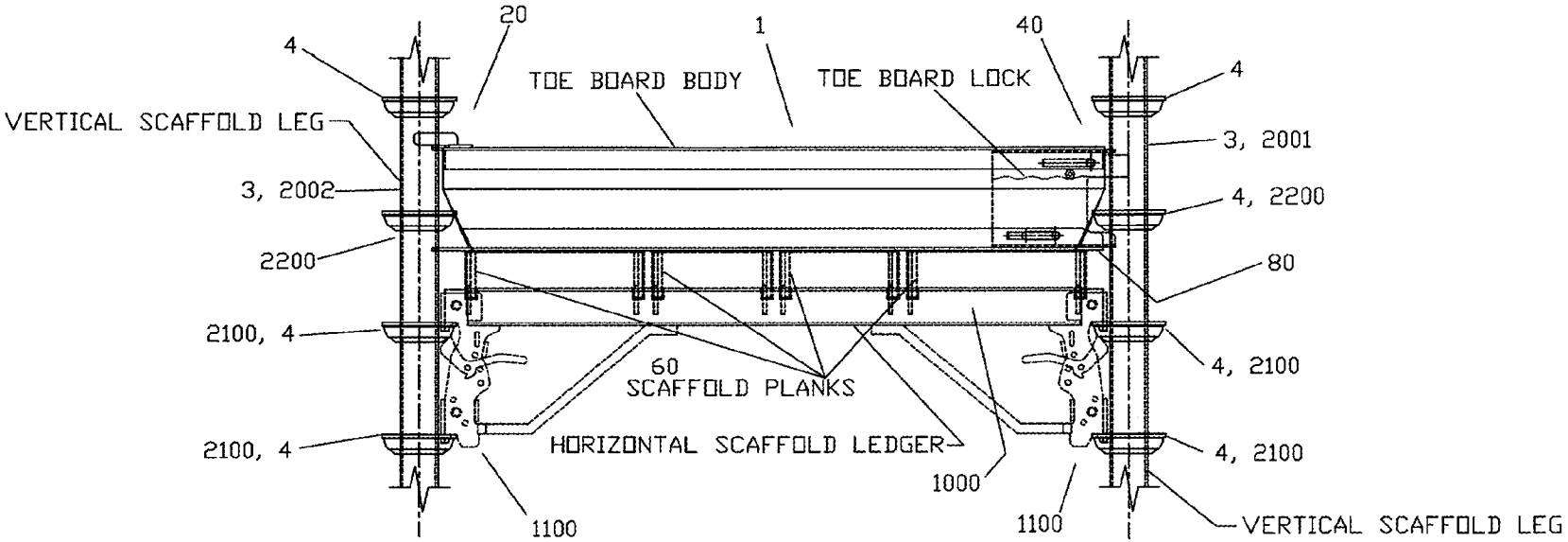
FIG. 2 is a front view of one embodiment of a toeboard system mounted between verticals on a scaffold frame.
Figure 3:
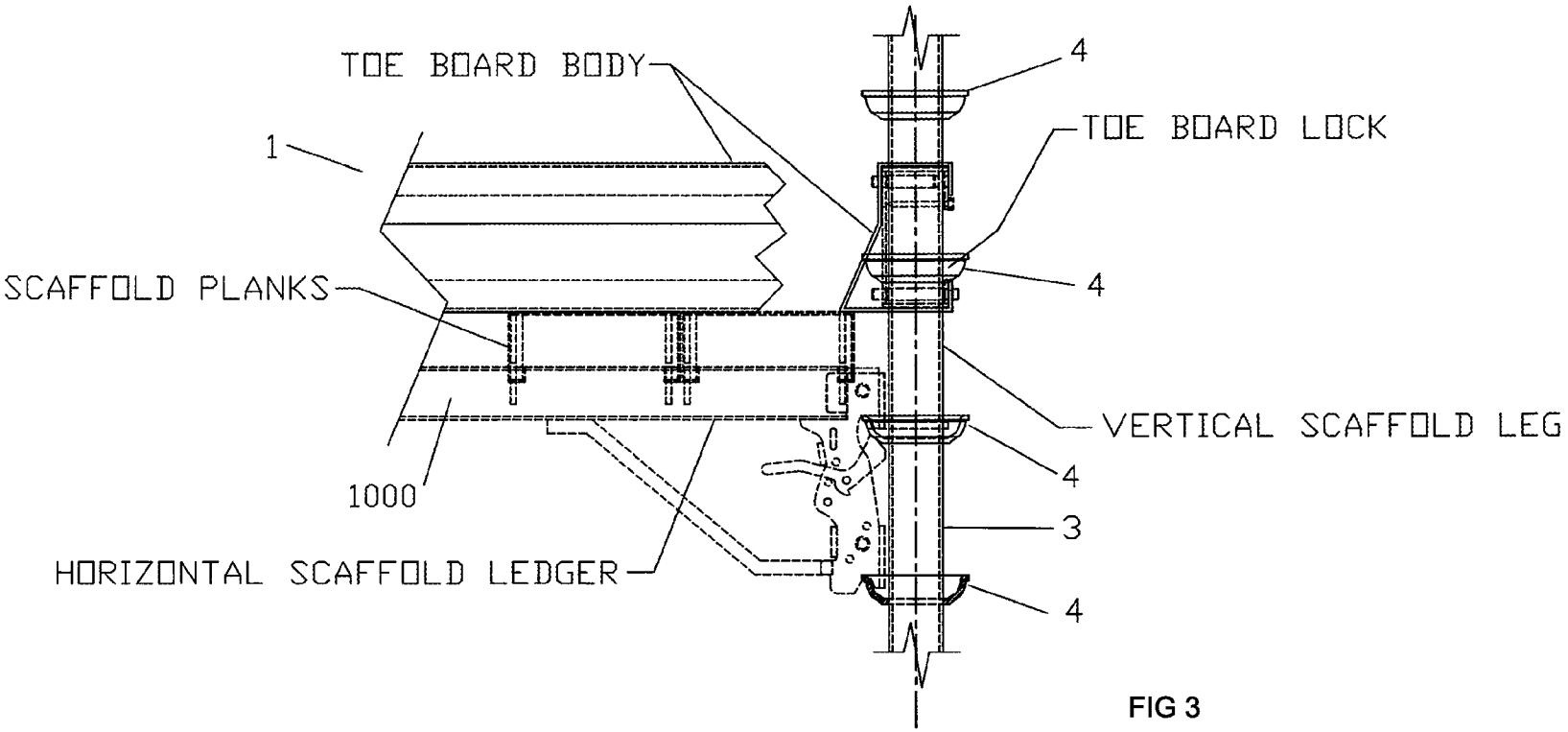
FIG. 3 is a front view of one embodiment of a toeboard system, showing a toeboard body supported by the working surface or deck.

The sloped section 5 on the front side 100 of the toeboard 1 is preferred but is not required. The toeboard 1 can be in the range of 3-6 or 7+ inches in height, depending on the application or the scaffold type to which it will be attached. In FIGS. 1-3, the toeboard 1 will be described with reference to the Excel Modular Scaffold System, where vertical scaffold members 3 have annular upstanding cups 4 positioned about every six inches on the vertical tubular member 3. FIG. 2 shows the toeboard 1 installed between two vertical scaffold members 3. Each of the vertical scaffold members shown is a cylindrical shaped tubular member, but the invention is not so limited. As shown in FIG. 2, the scaffold horizontal member 1000 is positioned between two scaffold vertical members 2001 and 2002, each having annular cups 4 attached thereto. The scaffold horizontal member 1000 has end connectors 1100 at each end of the horizontal member that couple a particular vertical cup(s) 2100. As shown, each end connectors 1100 couples to two adjacent vertical cups 2100, which adds stability, but is not required.

Once the horizontal 1000 and vertical scaffold members 3 are assembled into a scaffold frame, scaffold planks 60 are positioned between spaced apart horizontal members 1000 at a particular height to create a working surface. While scaffold planking 60 may be a wooden board, a more preferred scaffold plank is a metal board (generally a U-shaped board to provide stiffness) where the underside of the board has, at each end, cutout members attached thereon. The cutout members are metal plates that have a section removed or cut out, where the exposed edge of the remaining material is shaped accommodate the shape of the horizontal scaffold member 1000 on which it will rest. In many cases, the cutouts sections can be semicircles or arcs where the horizontal members are cylindrical tubular or pipe members.

As can be seen in FIG. 2, the resulting top surface 80 of the scaffold floor lies slightly below one of the cups 4 on the scaffold vertical members 3. Also shown in FIG. 2 is one embodiment of the toeboard 1 installed between two vertical scaffold members 3, where the toeboard 1 bottom portion 31 rests on the top 80 of the scaffold deck. The sloped section 5 of the toeboard (which faces the interior of the scaffold frame) kicks the front bottom portion 31 of the toeboard 1 further toward the interior of the scaffold frame, and provide additional area on the bottom portion 31 surface for support. See FIG. 3. The toeboard 1 consequently acts to "hold down" or constrain upward motion of the installed scaffold planks 60. As shown in FIG. 1A, the front side 100 of the toeboard may have openings 91 therethrough (aligned with similar openings in the bottom portion 31) to accommodate a nail or a screw to allow the toeboard 1 to be attached to a wooded scaffold plank or planks.

The toeboard 1 in FIG. 1 has a fixed terminating end 20 and an adjustable terminating end 40. Positioned on or integrally formed on the fixed terminating end is a tailpiece 7A. A separate tailpiece 7A can be attached to the top edge of the fixed end of the toeboard (such as by riveting as shown n FIG. 1A, welding or other means). The tailpiece 7A is located on the top edge 30 of the toeboard. Tailpiece 7A, as shown, has a shaped or cutout edge 36, shaped to embrace the vertical members. For cylindrical pipe shaped vertical scaffold members, the cutout can be a semicircle or arc area, such as depicted in FIG. 1D. Also, as shown in FIG. 1D, the edges 37 of the tailpiece 7A are not square, but are cut at an angle (for instance 45-60 degrees), to allow two toeboards to be placed in a 90 degree relationship at a corner of the scaffold deck (see for instance, FIG. 7B). The terminating ends of the toeboard 1 may be further shaped to accommodate the annular members on the vertical scaffold member or the sloped area of an adjacent toeboard. For instance as shown in FIG. 1B, the terminating edges 20 and 40 are cut back at an angle or on a curve to provide clearance from an annular member (see FIG. 2B) or an adjacent toeboard mounted at 90 degrees (see FIG. 8B). The toeboard 1 defines a lengthwise axis, generally along a line extending between the two terminating ends (e.g., a line extending between the verticals when the toeboard is installed).

As shown in FIG. 1A, the tailpiece 7A includes two projecting fingers 38 that extend outwardly from the front top portions 30 of the toeboard 1. The fingers 38 help to stabilize the fixed end 20 of the toeboard 1 when coupled to a vertical member 3. The two fingers 38 may be separated vertically on the fixed end 20 of the toeboard 1 (for instance the front portion may have an integral or attached projecting finger near the top portion 30, and the rear portion of the toeboard may have a second projecting finger mounted near or integral with, the bottom portion 31). The "horizontal" distance between the two projecting fingers 38 (the distance between the two fingers projected onto a horizontal plane) should be slightly greater than the diameter of the vertical member at the terminating ends of the projecting fingers 38. As shown, the tailpiece's projecting fingers forms a slight "V" shape to assist in wedging the fingers 38 against the vertical scaffold member 3 when engaged to the vertical member 3. The fingers 38 extend outwardly from the front terminating end generally along the axis of the toeboard. The bottom portion 31 of the fixed end 20 of the toeboard may also include a shaped tailpiece section 7B, shaped to engage the vertical member. The projecting fingers 38 and shaped areas help the fixed end 20 of the toeboard to resist rotation about a coupled vertical member.

Figure 4B:
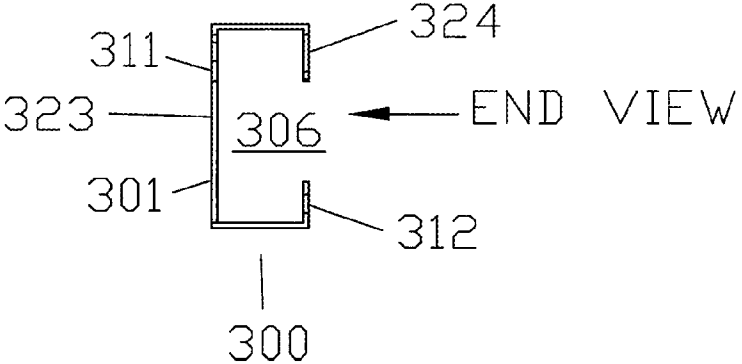
FIG. 4B is a cross section through the lock member body of FIG. 4A.
Figure 4A:
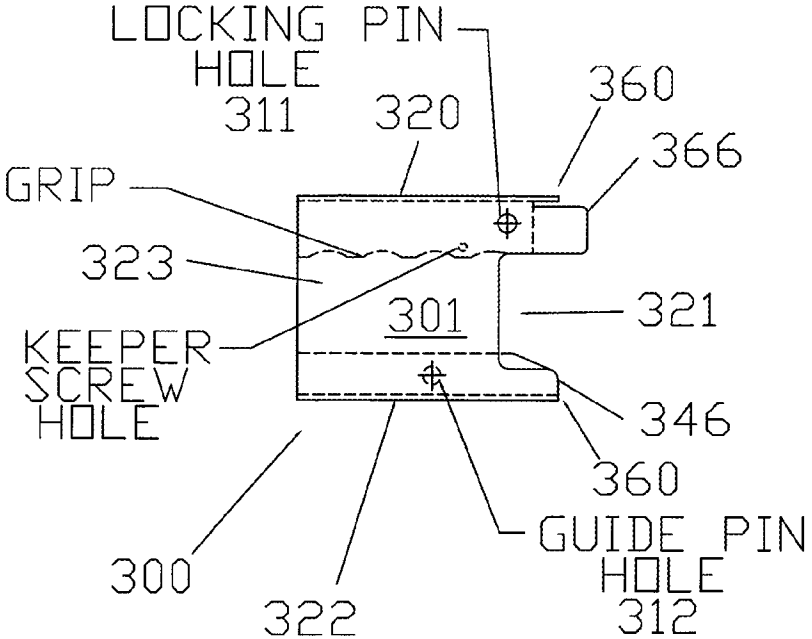
FIG. 4A is a front view of one embodiment of a lock member body.

The terminating end of the toeboard 1 opposite the fixed end is the adjustable terminating end 40. Preferably, the adjustable end 40 will have mounted thereon a lock mechanism 300 that is slidable with respect to the toeboard 1, such as being slidable in the toeboard's interior channel 90. Preferably, the lock mechanism 300 also includes shaped ends 360 or cutouts for engaging with the vertical scaffold member 3 (see FIG. 1A). One embodiment of the slidable locking mechanism is shown in FIG. 4. The locking mechanism 300 includes a lock member body 301, shown as a generally square U shaped member sized to slide in the channel interior 90 of the toeboard 1. The lock member body 301 has a top sidewall 320, a bottom sidewall 322, a front sidewall 323, a rear sidewall 324 and a front terminating end 321. As shown in FIG. 4B, one embodiment of the lock member body 301 is a U-shaped in cross section, with one sidewall (as shown, the rear sidewall 324) being a split wall. Also note that the front and rear sidewalls have an area of the wall near the front edge removed, to avoid interference with an annular member that will be present in an Excel System (see FIG. 2). The lock member body 301 preferably has a hollow interior 306. Preferably, at least one lock, such as a spring loaded clip lock, snap button or lock or pushpin lock, will be disposed in this interior 306. Openings 311 and 312 are located in the lock member body (as shown, one in the front sidewall portion 323 and one in the rear sidewall 324 of the lock member body) to accommodate the lock.

As shown in FIG. 4, one embodiment of the slidable locking mechanism may have a finger(s) or tab(s) 366 (two such are shown in FIG. 1A) and bottom tail 346. The bottom tail's 346 front terminating end may be shaped for engagement with a vertical scaffold member 3. Between the tabs or fingers 366, the lock member body 300 may also be shaped 360 to engage the vertical scaffold members 3, such as being semicircular or arc shaped. The projecting fingers or tabs 366 preferably extend outwardly from the front sidewall of the lock member body 301 so that, when the locking mechanism is slid out from the interior of the toeboard channel 90 into a locked or deployed configuration (see FIG. 5A), the fingers or tabs 366 will be adjacent to the coupled vertical scaffold member, trapping the vertical scaffold member between the fingers or tabs 366 (thereby locking the toeboard 1 in place horizontally). The tabs 366 preferably are a length of about ⅛, ¼, or ½ of the diameter of a vertical scaffold member.

The bottom tail 346 can be eliminated, but removal allows some rotation of the toeboard about the vertical member, which is not preferred. As shown, the two tabs 366 are near the top sidewall of the lock member body, but could be located near the bottom sidewall, on the remaining sidewalls, and the two tabs do not have to be vertically aligned (extending from the same height on the lock member body). As shown, the vertical extent of the tabs are about ⅛ the width of the toeboard. However, the tabs 366 could extend almost the entire height of the lock member if interference with an annular cup on a vertical 3 is not an issue. In the embodiment shown in FIGS. 2 and 4, interference is an issue, so lock body behind the tabs is shaped to accommodate an interfering cup or annular member (see FIG. 2, showing interfering cups 2200).

Shown in FIG. 1D is a locking pin hole (shown located on the front sidewall) and a guide pin slot (shown as located on the rear side of the toeboard). When the lock body member 301 is slid outwardly from the channel 90 in the toeboard, into a locked or deployed configuration, the opening 311 in the lock member body will align with the locking pin hole in the toeboard. A snap button lock or clip 377 located in the interior of the lock member body (with the button or pin located in opening 311) will consequently lock the position of the lock member body 301 with respect to the toeboard 1 into the locked or deployed position. See FIG. 6A. The toeboard 1 may have a separate opening in the toeboard positioned further back for the adjustable terminating end to allow the lock or clip 377 to lock the position of the lock member body 301 in the open or retracted position of FIG. 6B.

Located on the rear portion of the toeboard is a guide pin slot 73 (shown ghosted in FIG. 6B). The guide pin slot 73 is an oblong slot in which a preferably spring loaded guide pin positioned on or within the lock member body 301 rides. The guide pin slot 73 has a rear extent and a front extent. The rear extent acts as a stop in conjunction with a guide pin to prevent the lock member body 301, when unlocked, from sliding too far in the interior of the toeboard 1. The front extent of guide pin opening also acts as a stop, to prevent the lock member body from sliding completely off the toeboard and becoming lost or misplaced when not in use. The guide pin may be actuatable spring loaded guide pin or a spring loaded clip pin. The guide pin slot may be located on the front portion of the toeboard, or eliminated.

In operation, a toeboard 1 is installed as follows: once the scaffold floor is installed, the fixed terminating end 20 of a toeboard 1 is slid into position adjacent a vertical scaffold member 3 (at the edge of the scaffold floor). The tail piece or pieces 7A of the fixed end 20 allow the toeboard 1 to be positioned and captured adjacent to the vertical scaffold member 3. When the fixed end engages a vertical 3, preferably both the top portion and bottom portion will touch or contact the vertical. With the locking mechanism 300 retracted or opened (FIG. 6B), the adjustable end 40 of the toeboard 1 is slid or pivoted adjacent the opposing vertical scaffold member 3. The lock member body 301 is released (if latched in the open position) and slid or extended forward to the locked position, bringing the tabs or fingers 366 forward to capture the vertical scaffold member 3 between the tabs or fingers 366. The tabs or fingers 366 preferably extend about ⅛ to ¼ to ½ of the diameter of the vertical scaffold member, and the extended locking member is locked in the extended or closed position by a locking clip or pin 377 or other lock means. Preferably, when engaged, both the top sidewall 320 and bottom sidewall 322 of the lock member body will contact or touch the vertical member 3.

Generally, a toeboard 1 will be placed between each pair of vertical scaffold members 3 on the outer perimeter of the scaffold deck (excluding access points to the scaffold deck). Preferably, the toeboards 1 are orientated so that the adjustable end 40 of a first toeboard 1 is positioned adjacent the fixed end 20 of the adjacent toeboard. When installed, the design of the fixed ends projecting fingers (if present) should be accounted for in the design of the projecting fingers or tabs on the adjustable terminating end, to avoid interference between adjacent toeboards. For instance, as shown in FIG. 4, the top of the projecting tabs 366 is setback or slightly lower than the top sidewall of the lock member body 301. This setback is to help reduce interference with the fixed end's shaped top sidewall 30 or projecting fingers 38 (if present) of an adjacent toeboard.

As described, the toeboard directly couples to the vertical scaffold members, instead of indirectly coupling to a third member (such as a sleeve) that couples to a vertical scaffold member. Note, for the scaffold system depicted in FIGS. 1-3 (the Excel system), the bottom edge of an installed toeboard 1 is located immediately below a vertical scaffold annular member 4 (see FIG. 2). Consequently, when the toeboard 1 is locked in position, it cannot be lifted off the verticals 3; that is, the toeboard is locked in place both horizontally and vertically. In other scaffold systems, the top of the toeboard 1 may be adjacent a vertical scaffold annular member, providing the preferred vertical "lock" of the toeboard. However, for some scaffold systems, annular members 4 (such as a cup or rosette) may not be positioned on the vertical scaffold member 3 to provide the vertical restraint to an installed toeboard. In such systems, a toeboard holddown can be used to provide the vertical restraint.

One embodiment of a toeboard holddown 500 is shown in FIG. 9. As shown, the holddown 500 includes an attachment member 510, to attach the holddown 500 to a vertical scaffold member 3. The attachment member can include a clamp, such as a pivoting or hinged tube clamp shown in FIGS. 9C and 9D, adapted to clamp onto the vertical tubular member 3. Alternatively, the clamp may be adapted to clamp onto an annular member 4 positioned on a vertical scaffold member, such as using the wedge as a clamp, as shown on FIG. 10. In this embodiment, the locking member 510 includes two offset aligned openings 560 on the holddown, offset about the thickness of the rosette. In positioning the wedge 570 through the openings 560 and the rosette opening on the vertical member, the wedge 570 acts to clamp the holddown to the rosette on the vertical member.

Figure 12B:
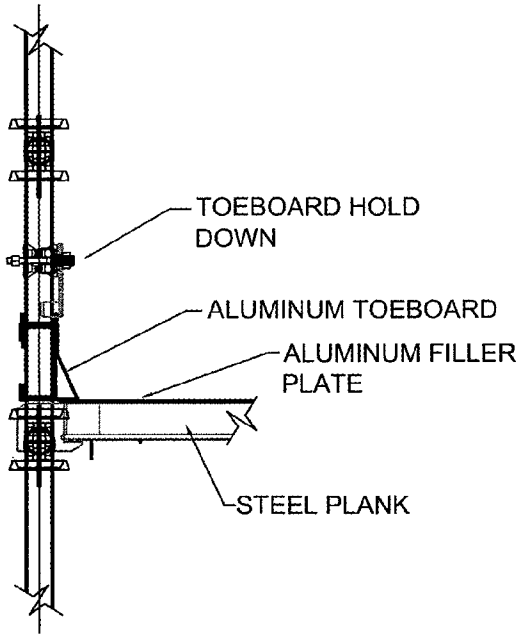
FIG. 12B is a cross sectional view through FIG. 12A.
Figure 12A:
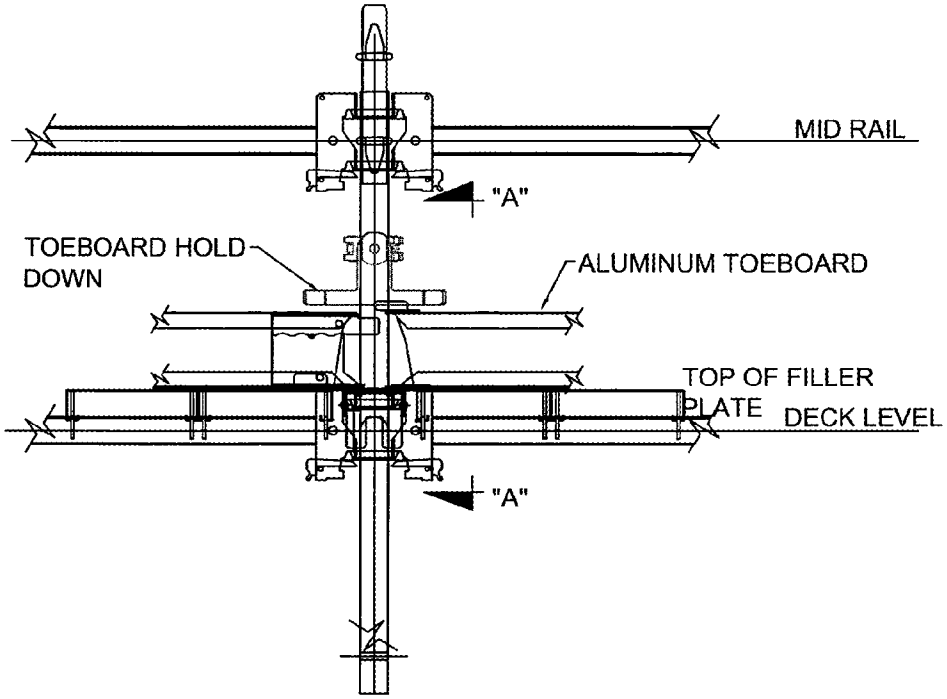
FIG. 12A is a front view of one embodiment of a holddown installed on a Safeway scaffold system frame.
Figure 13B:
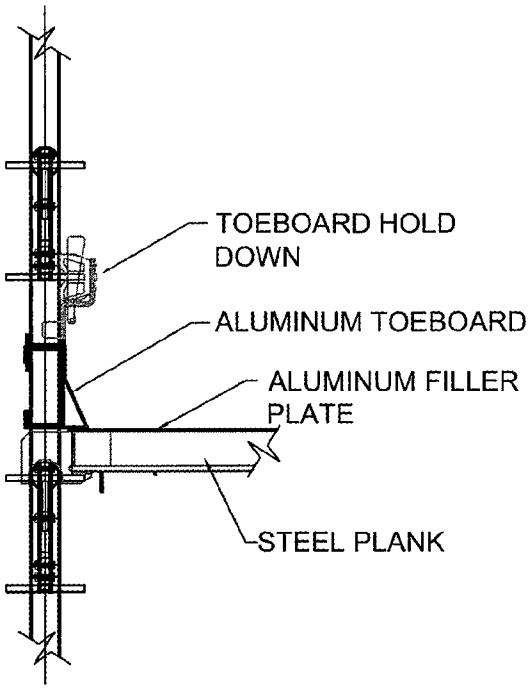
FIG. 13B is a cross sectional view through FIG. 13A.
Figure 13A:
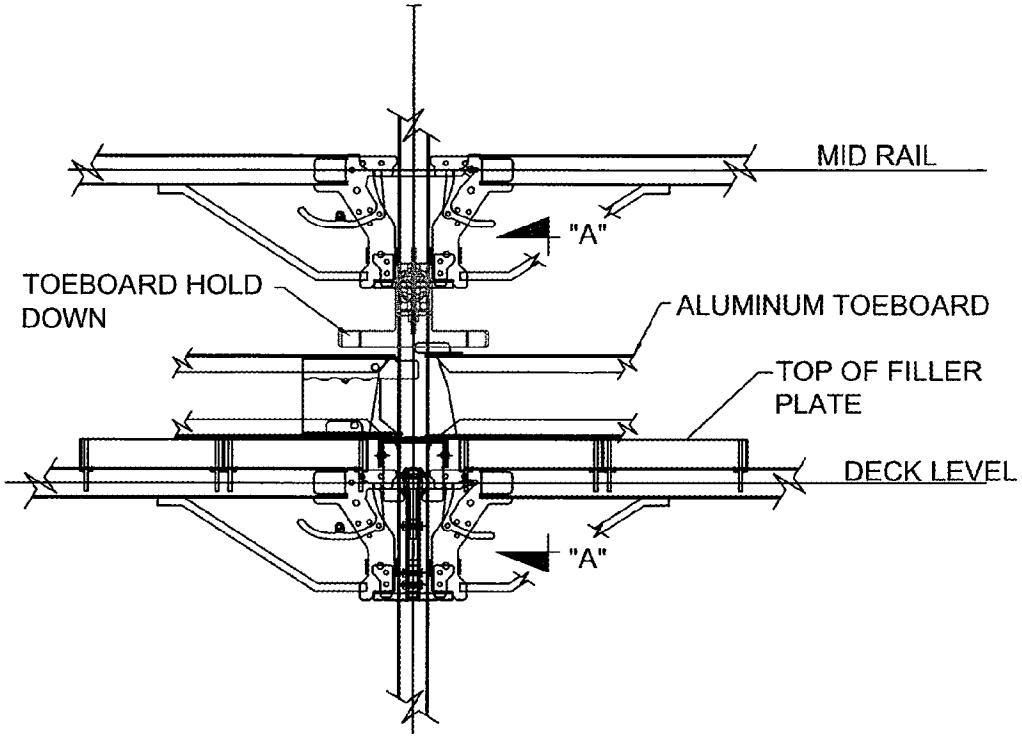
FIG. 13A is a front view of one embodiment of a holddown installed on a Next Gen scaffold system frame.
Figure 14B:
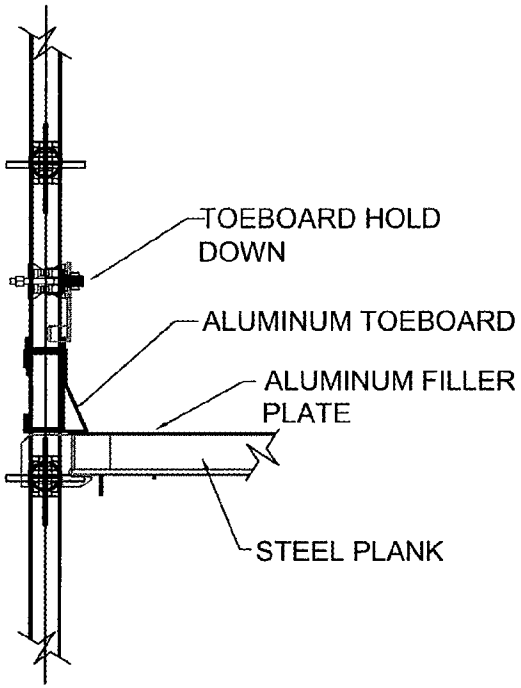
FIG. 14B is a cross sectional view through FIG. 14A.
Figure 14A:
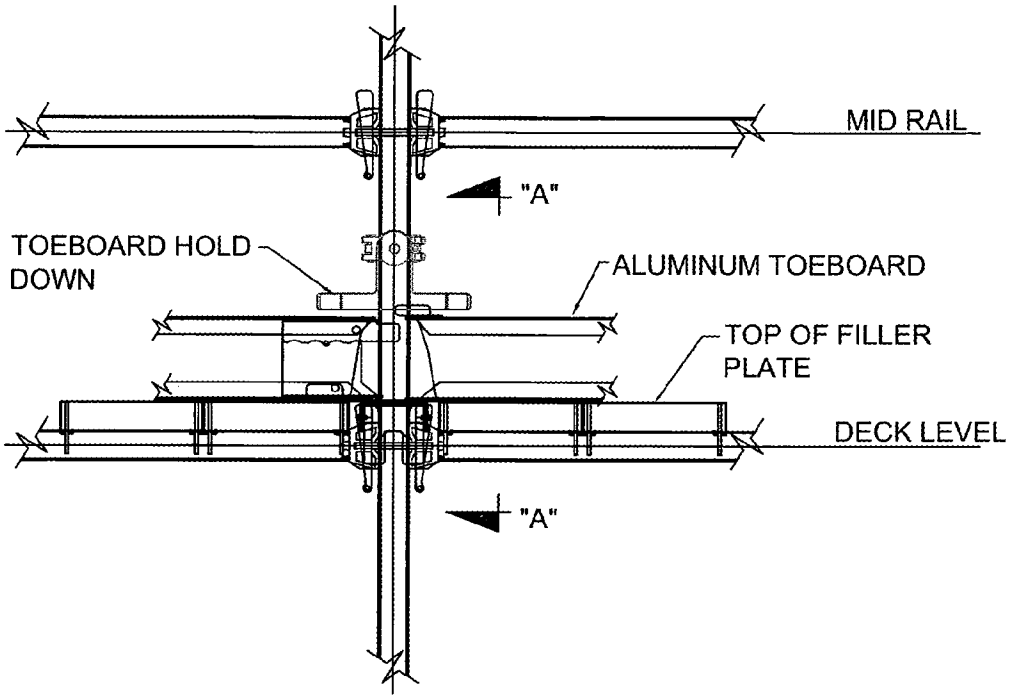
FIG. 14A is a front view of one embodiment of a holddown installed on a wedge lock scaffold system frame.

The holddown 500 shown in FIGS. 9 and 10 include a "T" shaped member 590, having two projecting arms 591 and 592 forming the "top" of the "T." The projecting arms may be flat extensions, may be bent (such as shown in FIG. 9D or 10D) or curved (not shown). The holddown 500 will be mounted on a vertical scaffold member 3 above a toeboard. The clamp will be positioned so the projecting arms 591 and 592 of the holddown 500 are located adjacent to the top edge 30 of a toeboard, such as depicted in FIGS. 12-14. The arms 591 and 592 extend over the toeboard, and hence, the arms resist upward movement of an installed toeboard 1. As shown in FIGS. 12-14, a single "T" shaped holddown can be mounted to a vertical to restrain two inline toeboards 1, or to two toeboards coupled to a vertical member at an angle (such as a 90 degree angle present at an outer corner of a scaffold deck).

Figures 11A, 11B, 11C, 11D:
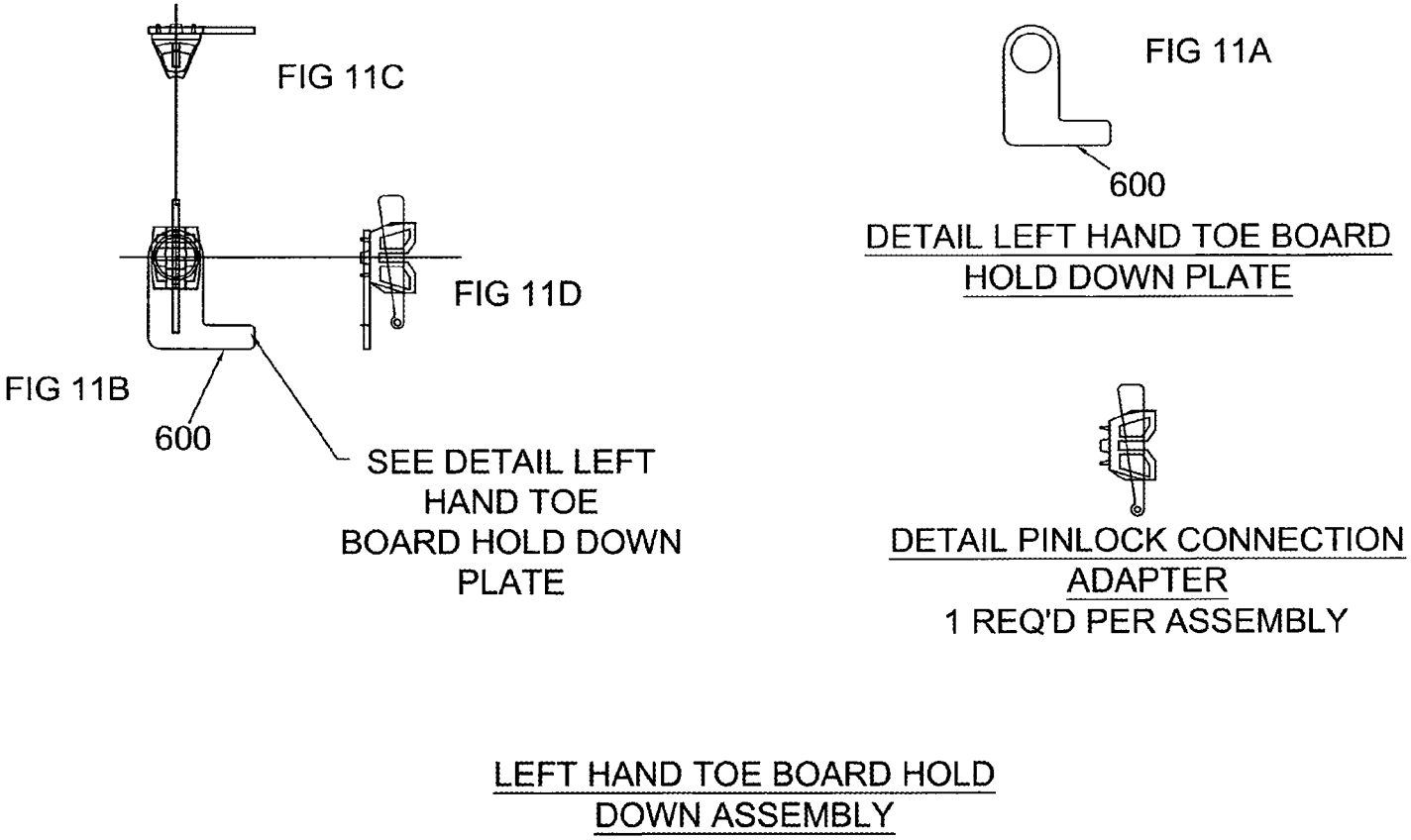
FIG. 11A is a front view of another embodiment of a toeboard holddown body.
FIG. 11B is a front view of another embodiment of a toeboard holddown.
FIG. 11C is a top view of the embodiment of the toeboard holddown of FIG. 11B.
FIG. 11D is a side view of the embodiment of the toeboard holddown of FIG. 11B.

Alternatively, the holddown 500 can be a straight plate like member with the clamp positioned in the center (not shown), or a holddown 500 having a single projecting arm 600, forming an "L" shaped member, such as shown in FIG. 11. The single projecting arm is shown as flat or planar in FIG. 11, but the arm could be bent or curved. For instance, at a corner of the platform deck, the "L" shaped single projecting arm holddown can be used to holddown a single toeboard. To vertically restrain two inline toeboards joined at a vertical scaffold member between the two toeboards, two single arm holddowns could be used (one per toeboard), one mounted near the front portion of one toeboard, the other mounted near the rear portion of the other toeboard. Single arm holddowns can also be manufactured as a "right" and "left" orientated or "handed" single arms. Alternatively, the holddown may simply be a clamp body, such as clamp 510 (FIG. 9D) with no projecting arms attached. The clamp alone may provide sufficient lateral extension to trap the toeboards in place vertically.

Figure 7B:
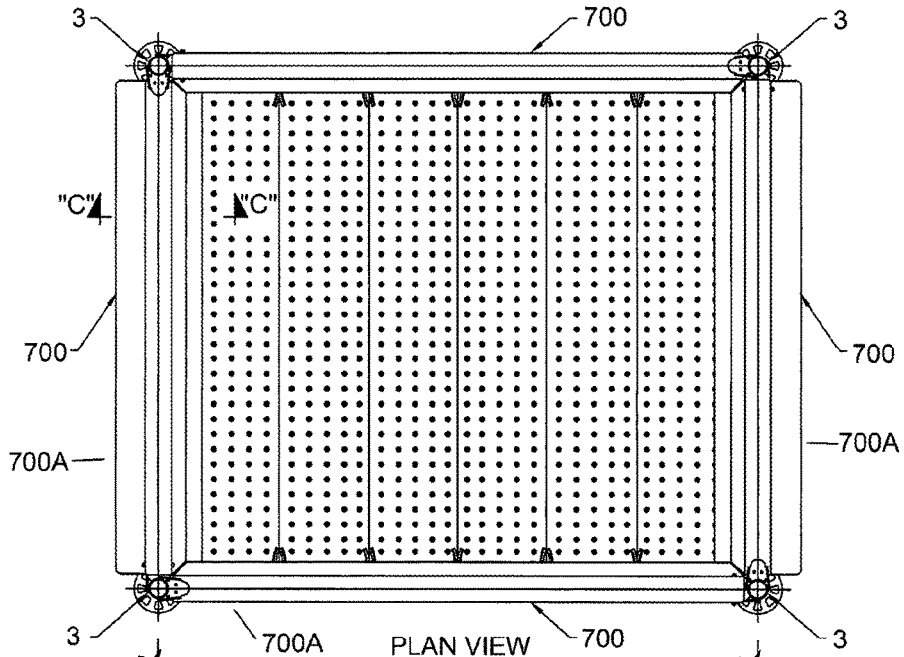
FIG. 7B is a top view of one embodiment of a scaffold deck on a Next Gen system scaffold frame.
Figure 7A:
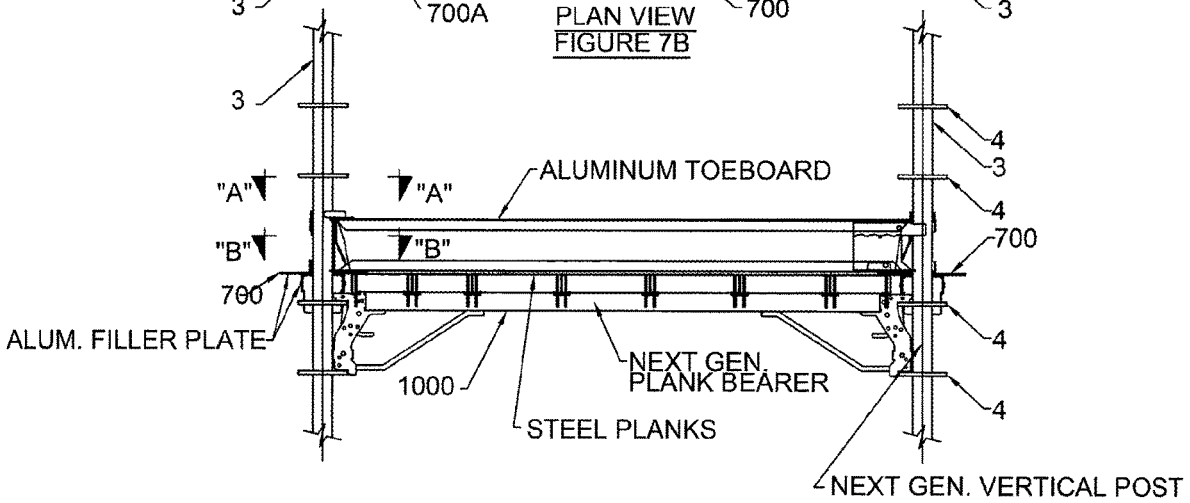
FIG. 7A is a side view of one embodiment of the scaffold toeboard system installed in a Next Gen system scaffold.
Figure 8C:
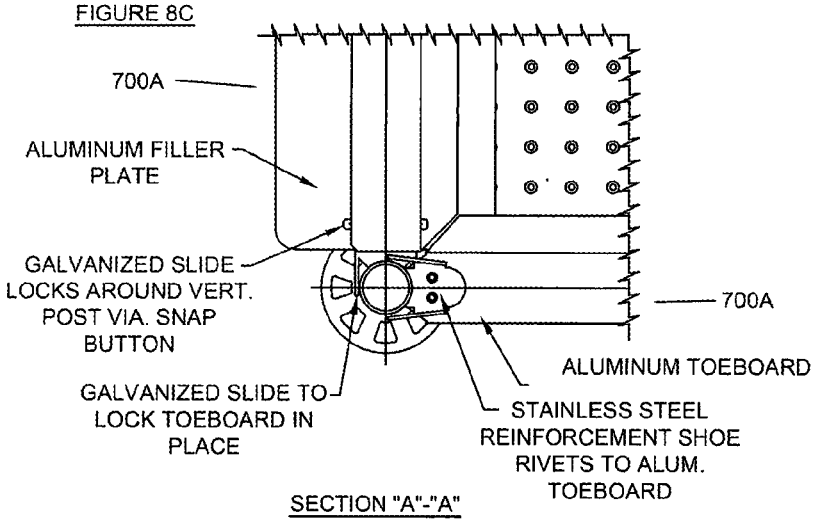
FIGS. 8A, 8B and 8C are sections taken through the scaffold frame of FIGS. 7A and 7B.
Figure 8B:
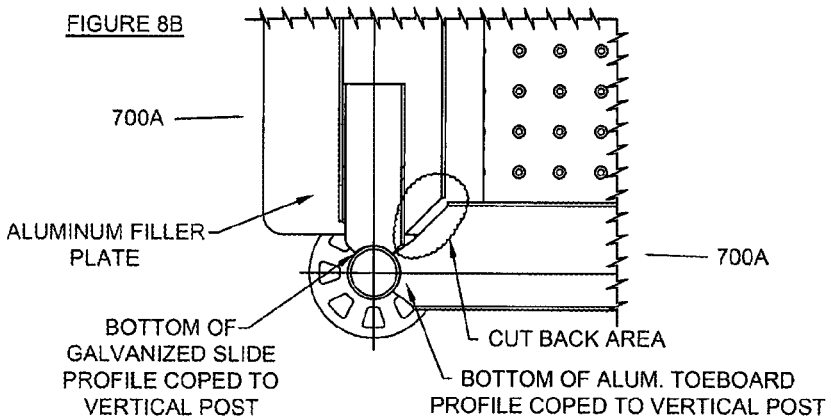
Figure 8A:
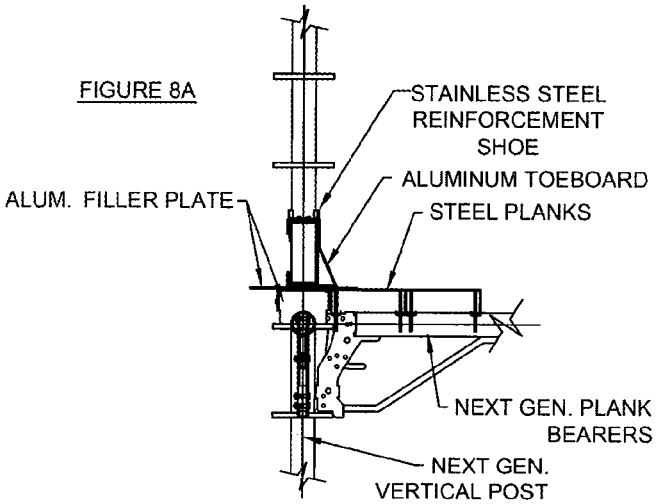
Figures 15A, 15B, 15C, 15D:
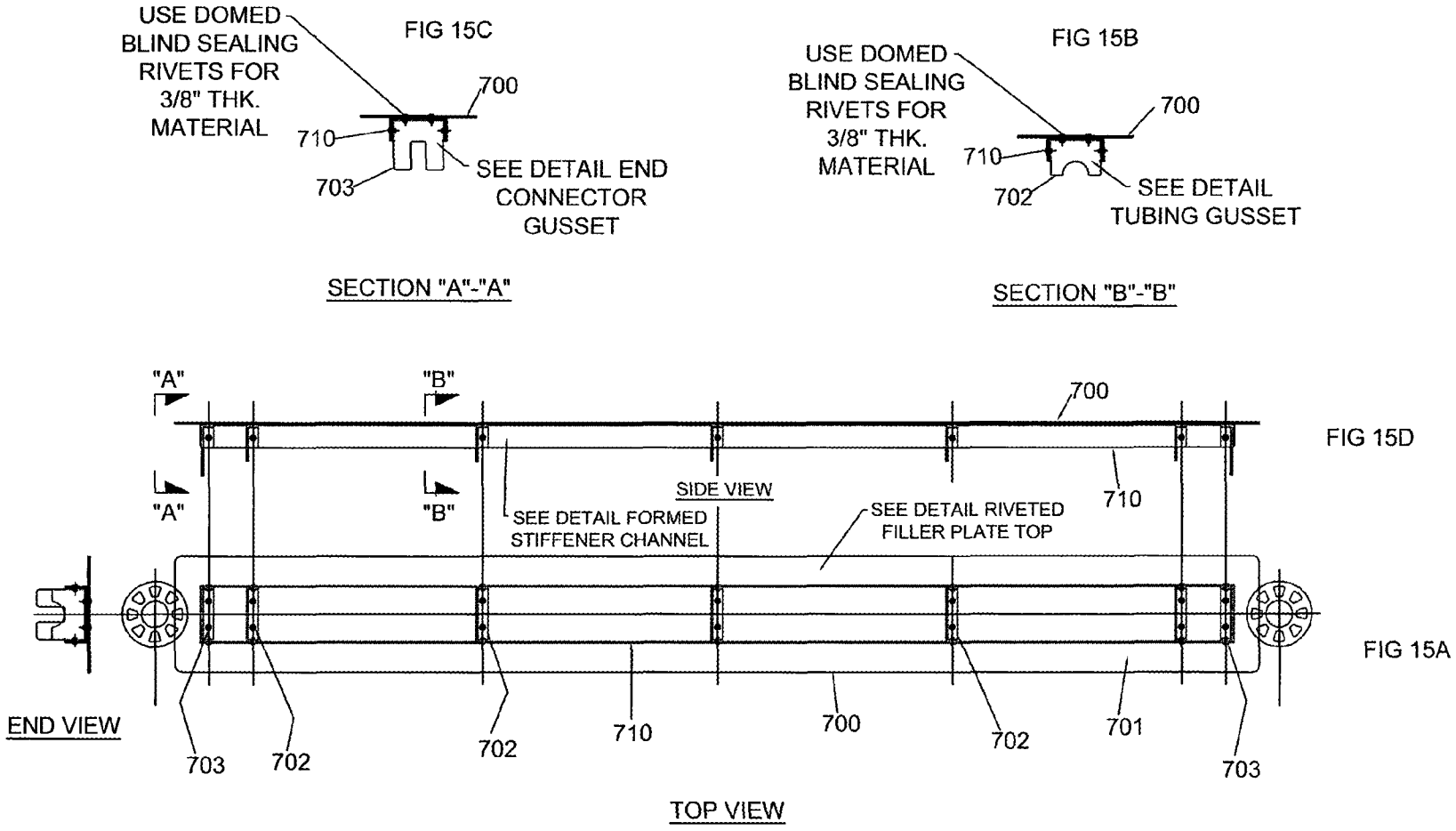
FIG. 15A is a top view of one embodiment of a filler board.
FIG. 15B is a cross sectional view of the filler plate of FIG. 15A.
FIG. 15C is another cross sectional view of the filler plate of FIG. 15A.
FIG. 15D is a side view of the embodiment of the filler plate of FIG. 15A.

On a particular rectangular scaffold working deck, the edges of the scaffold planks may not extend sufficiently far to the outer perimeter to provide horizontal floor support for a toeboard. This may be due to the design of the scaffold planks, or may result from how the scaffold planks are mounted onto the supporting horizontal members. In this instance, a filler plate 700A can be used to support the toeboard 1, where the filler plate 700A will be supported by the horizontal member 1000 that connects the two verticals 3 to which the toeboard 1 will be coupled. One embodiment of filler plate is shown in FIG. 15. As shown, the filler plate includes a flat deck member 700, such as a metal plate. Generally, the deck member 700 is dimensioned similarly to metal scaffold deck planking, and can come in various lengths, such as 6-12 feet. Centered on the underside of the deck member 700 is a box U-shaped channel 710. Periodically positioned in and across this channel are cutout plate members 702, where the plate members have generally semicircular or arc shaped cutout section (when the horizontal scaffold members are round pipes) to embrace and rest on a horizontal scaffold member 1000. The cutouts are sized in depth so that when the cutout is resting on a horizontal scaffold member 100, the bottom underside of the deck member 700 is resting on top surface of a scaffold deck. At each terminating end of the channel 701, the filler plate may include a cutout member 703 where the cutout is shaped to accommodate the end connector positioned on the horizontal member. For instance, for Excel type end connectors, the cutout 703, shown in FIG. 15C, is more rectangularly shaped than arc shaped. The rectangular shape captures the horizontal members end connector, and helps resist rotation of the filler plate 700A when mounted to a horizontal scaffold member 1000. FIGS. 8, 7A and 7B show filler plates 700A mounted onto a scaffold deck where the horizontal end connectors are the Next Gen type end connectors.

Figure 16:
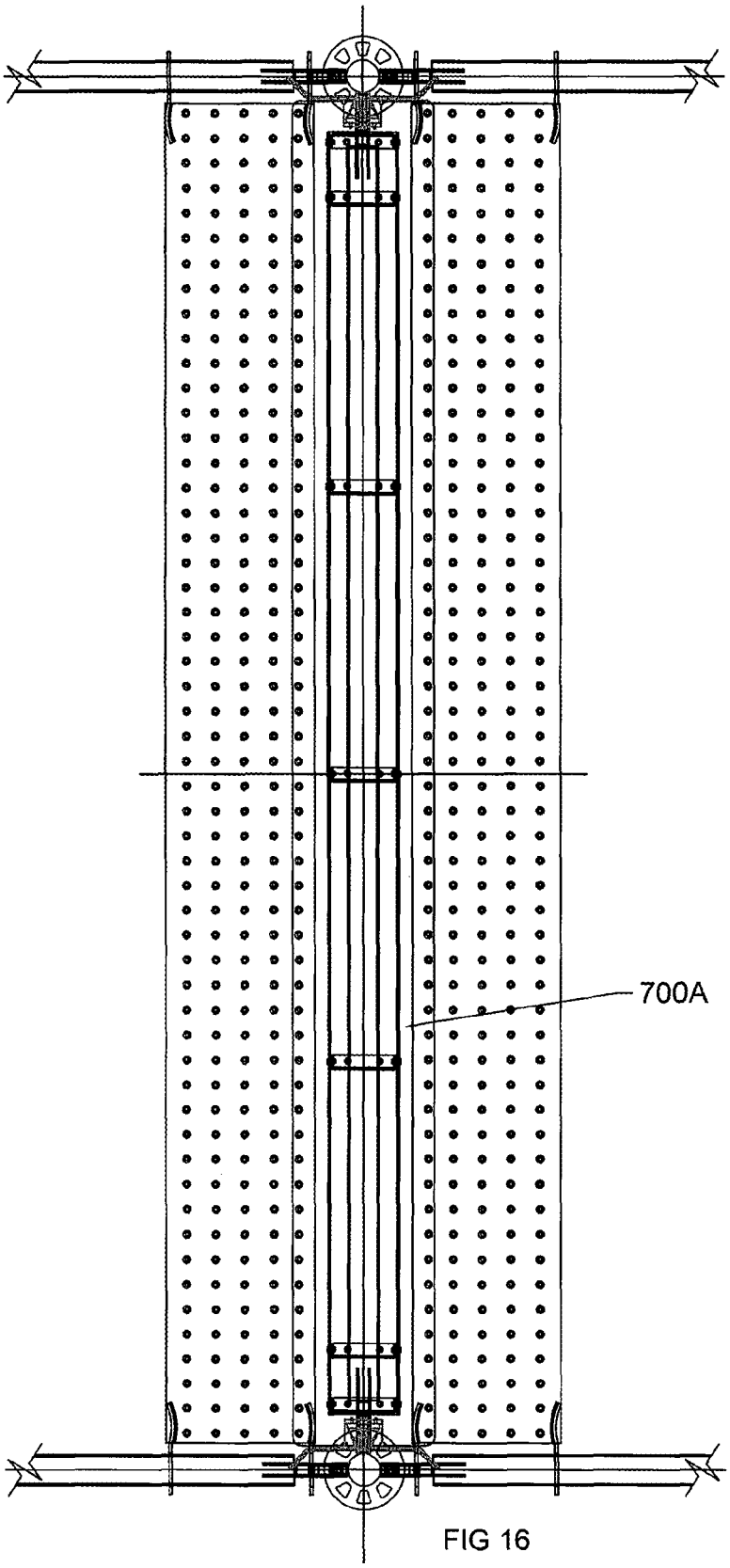
FIG. 16 is a top view of a scaffold deck depicting the filler plate of FIG. 15A positioned internal on a scaffold deck.

To use a filler plate 700A for supporting a toeboard 1, the filler plate 700A is positioned on the edge of the platform deck, aligning the center channel 710 with the outer horizontal scaffold member 1000. The filler plate 700A is lowered until the cutouts 702 and 703 are supported by the horizontal scaffold member and/or end connectors, and the underside of the deck member 700 is resting on the deck or scaffold floor. The toeboards 1 can then be positioned between the vertical scaffold members, supported from below by the installed filler plates 700A. As shown in FIG. 16, the filler plate 700A may also be used to bridge gaps in the interior of the scaffold deck.

While the illustrative forms disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the example and descriptions set forth herein, but rather that the claims be construed as encompassing all the features of patentable novelty which reside herein, including all features which would be treated as equivalents thereof by those skilled in the art to which this disclosure pertains.

When numerical lower limits and numerical upper limits are listed herein, ranges from any lower limit to any upper limit are contemplated.

The invention claimed is:

1. A scaffold toeboard system for locking a toeboard between a first and second vertical scaffold members, where each vertical scaffold member comprises a tubular member having a diameter and an outer shape;

said toeboard system comprising a toeboard lockable between the first and second vertical scaffold members, the toeboard comprising an elongated member having a fixed terminating end and an adjustable terminating end, with the fixed terminating end including two projecting fingers positioned thereon, and wherein the toeboard further comprises a front portion, a top portion, a bottom portion and a rear portion defining an interior;

a locking mechanism slidable within the interior of the toeboard, the locking mechanism comprising:

a lock member body having a front sidewall, a rear sidewall, a top sidewall, a bottom sidewall, and a front terminating end, wherein said lock member body is slidable from an engaged position to a retracted position, with the engaged position being defined by said front terminating end being distal to the adjustable terminating end of the toeboard, and with the retracted position being defined by said front terminating end being proximal to said adjustable terminating end of said toeboard;

two tabs positioned on said locking mechanism and extending outwardly from said front terminating end of the lock member body, said two tabs separated by a horizontal distance of about the diameter of said first or second vertical scaffold members; and a lock, said lock being actuatable to fix the position of the lock member body in the deployed position.

2. The combination of a toeboard system and a first and second vertical scaffold members, the first and second vertical scaffold members each comprising a tubular member having a series of outwardly extending annular members fixedly mounted on the tubular member, each tubular member having a diameter;

the scaffold toeboard system configured to lock said toeboard system between said first and second vertical scaffold members, said toeboard system including a toeboard comprising an elongated member having a fixed terminating end and an adjustable terminating end, the toeboard further comprising a front portion, a top portion, a bottom portion and a rear portion defining an interior;

a locking mechanism slidable in the interior of the toeboard between a retracted position and an engaged position, the locking mechanism comprising a lock member body having a front portion and a rear portion, top portion; a bottom portion, and a front terminating edge, and two tabs positioned on said locking mechanism and extending outwardly from said front terminating edge of the lock member body, said two tabs separated by a horizontal distance of about the diameter of said first or second vertical scaffold members; one of said two tabs positioned on or adjacent the front portion of the lock member body, the other of said two tabs positioned on or adjacent the rear portion of the lock member body;

the locking mechanism further comprising a lock adapted to releasingly fix the lock member body the engaged position.

3. The combination of claim 2 wherein the lock member body comprises top portion or bottom portion that is arc shaped to engage either said first or second vertical scaffold member.

4. The combination of claim 2 wherein the fixed terminating end includes a pair of fingers extending generally along a longitudinal axis of the toeboard, and having a horizontal distance between the two extending fingers sized to accept either the first or second vertical scaffold member therebetween.

5. The combination of claim 2 wherein said front portion of the toeboard comprises a sloped portion, whereby the top portion of the toeboard is smaller in width than the bottom portion of the toeboard.

6. The combination of claim 5 wherein said toeboard further comprises a tailpiece mounted to the top portion of the fixed terminating end of the toeboard, the tailpiece adapted to engage either said first or second vertical scaffold member, where the two offset fingers are generally extending from the toeboard along a longitudinal axis of the toeboard and having a horizontal distance between the two fingers that is sized to accept one of said first or second vertical scaffold members therebetween.

7. The combination of claim 5 further comprising a toeboard holddown comprising a clamp member.

8. The combination of claim 7 where said clamp member is a pivoting tube clamp.

9. The combination of claim 7 wherein said clamp member includes a wedge, and wherein said annular members on said vertical scaffold members comprise rosettes having openings therethrough.

10. The combination of claim 2 wherein said toeboard forms a U-shaped channel and said locking mechanism is slidable in said channel.

11. The combination of claim 2 wherein said lock comprise a snap pin, said lock member body having a first opening, said toeboard having a second opening, said first and second openings being alignable when the lock member body is in the engaged position.

12. A telescoping scaffold toeboard, comprising:

a) an elongated toeboard body, the elongated toeboard body comprising: i) a top wall, ii) a bottom wall parallel to the top wall, iii) a front sidewall connecting the top and bottom walls; iv) a first terminating end; and v) a second terminating end; wherein the top wall, bottom wall, and front sidewall define an interior channel; and wherein a length extending from the first terminating end to the second terminating end defines a longitudinal axis of the elongated toeboard body;

b) a telescoping sleeve assembly coupled to the first terminating end of the elongated toeboard body, the telescoping sleeve assembly comprising:

a lock member sleeve slidably coupled to the toeboard interior channel, the lock member sleeve having a top wall; a bottom wall parallel to the top wall; and a sidewall connecting the top and bottom walls, and first and second fingers projecting longitudinally from opposing sides of the top wall of the lock member sleeve, to enable attachment to a first vertical scaffold member in a scaffold assembly;

a lock member a spring member defining a first end and a second end, wherein the first end is fixedly attached to the lock member sleeve with a mounting fastener, and wherein the second end comprises a button accessible through an opening formed in the sidewall of the elongated toeboard body wherein the button, when extending through said opening in said toeboard body, fixes the lock member body with respect to the elongated toeboard, a pair of tabs extending from opposing sides of said lock member body along the longitudinal axis of the toeboard body, said tabs separated by a distance equal to the diameter of a first vertical scaffold member, a pair of fingers coupled to the second terminating end of the elongated toeboard body, the pair of fingers extending longitudinally along the axis away from said second terminating end, and each of said pair separated from the other of said pair by a distance equal to the diameter of a second vertical scaffold member.

* * * * *